US007740715B2

(12) United States Patent
Tomizawa

(10) Patent No.: US 7,740,715 B2
(45) **Date of Patent: *Jun. 22, 2010**

(54) R-T-B BASED SINTERED MAGNET

(75) Inventor: Hiroyuki Tomizawa, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/560,863

(22) Filed: Sep. 16, 2009

(65) Prior Publication Data

US 2010/0003160 A1 Jan. 7, 2010

Related U.S. Application Data

(63) Continuation of application No. 12/132,689, filed on Jun. 4, 2008, now abandoned, which is a continuation of application No. PCT/JP2007/059373, filed on May 2, 2007.

(51) Int. Cl.
*H01F 1/057* (2006.01)

(52) U.S. Cl. ..... 148/302; 75/244; 148/101

(58) Field of Classification Search ..... None
See application file for complete search history.

(56) References Cited

U.S. PATENT DOCUMENTS 5,266,128 A 11/1993 Bogatin
2003/0098094 A1* 5/2003 Hasegawa et al. ..... 148/302
2006/0213584 A1* 9/2006 Nakamura et al. ..... 148/302

FOREIGN PATENT DOCUMENTS

EP 1 705 671 A2 9/2006

OTHER PUBLICATIONS

Tomizawa; "R-T-B Based Sintered Manet", U.S. Appl. No. 12/132,689, filed Jun. 4, 2008.

Official Communication issued in corresponding European Patent Application No. 07742808.4, mailed on Jun. 19, 2009.

English translation of Official Communication issued in corresponding International Application PCT/JP2007/059373, mailed on Dec. 3, 2009.

* cited by examiner

*Primary Examiner*—John P Sheehan
(74) *Attorney, Agent, or Firm*—Keating & Bennett, LLP

(57) ABSTRACT

An R-T-B based sintered magnet according to the present invention has a composition comprising: 12 at % to 15 at % of a rare-earth element R; 5.0 at % to 8.0 at % of boron B; 0.1 at % to at % of Al; 0.02 at % to less than 0.2 at % of Mn; and a transition metal T as the balance. The rare-earth element R is at least one element selected from the rare-earth elements, including Y (yttrium), and includes at least one of Nd and Pr. The transition element T includes Fe as its main element.

6 Claims, 3 Drawing Sheets

| No. | CHEMICAL SYMBOLS | | | | | | | | | | | | | | | | |
|---|---|---|---|---|---|---|---|---|---|---|---|---|---|---|---|---|---|
| | Pr | Nd | Tb | Dy | Fe | Co | Mn | Al | Cr | Cu | Mo | Ga | Zr | B | C | N | O |
| 1 | 0.00 | 13.8 | 0.00 | 0.00 | 77.8 | 0.00 | 0.02 | 0.12 | 0.00 | 0.10 | 0.00 | 0.00 | 0.00 | 5.91 | 0.22 | 0.023 | 1.94 |
| 2 | 0.00 | 13.9 | 0.00 | 0.00 | 77.7 | 0.00 | 0.02 | 0.24 | 0.00 | 0.10 | 0.00 | 0.00 | 0.00 | 5.99 | 0.21 | 0.023 | 1.86 |
| 3 | 0.00 | 13.8 | 0.00 | 0.00 | 77.5 | 0.00 | 0.02 | 0.48 | 0.01 | 0.10 | 0.00 | 0.00 | 0.00 | 5.97 | 0.22 | 0.028 | 1.85 |
| 4 | 0.00 | 13.8 | 0.00 | 0.00 | 75.6 | 2.19 | 0.06 | 0.12 | 0.00 | 0.00 | 0.00 | 0.00 | 0.00 | 6.03 | 0.21 | 0.028 | 1.98 |
| 5 | 0.00 | 13.8 | 0.00 | 0.00 | 75.7 | 2.20 | 0.06 | 0.24 | 0.00 | 0.00 | 0.00 | 0.00 | 0.00 | 5.93 | 0.22 | 0.032 | 1.82 |
| 6 | 0.00 | 13.8 | 0.00 | 0.00 | 75.2 | 2.19 | 0.06 | 0.72 | 0.00 | 0.00 | 0.00 | 0.00 | 0.00 | 5.90 | 0.24 | 0.028 | 1.89 |
| 7 | 0.00 | 13.0 | 0.00 | 0.00 | 77.3 | 2.19 | 0.12 | 0.12 | 0.00 | 0.08 | 0.00 | 0.00 | 0.00 | 5.96 | 0.38 | 0.055 | 0.77 |
| 8 | 0.00 | 13.0 | 0.00 | 0.00 | 77.3 | 2.18 | 0.12 | 0.36 | 0.01 | 0.08 | 0.00 | 0.00 | 0.00 | 5.82 | 0.36 | 0.050 | 0.80 |
| 9 | 0.00 | 12.7 | 0.28 | 0.00 | 77.3 | 2.18 | 0.12 | 0.36 | 0.00 | 0.08 | 0.00 | 0.00 | 0.00 | 5.78 | 0.37 | 0.051 | 0.72 |
| 10 | 2.98 | 10.6 | 0.00 | 0.00 | 75.6 | 2.21 | 0.24 | 0.24 | 0.01 | 0.09 | 0.00 | 0.00 | 0.00 | 5.96 | 0.21 | 0.033 | 1.79 |
| 11 | 0.00 | 13.9 | 0.00 | 0.00 | 74.5 | 2.19 | 0.47 | 0.24 | 0.31 | 0.09 | 0.00 | 0.00 | 0.00 | 5.92 | 0.21 | 0.037 | 2.06 |
| 12 | 0.00 | 13.9 | 0.00 | 0.00 | 74.8 | 2.20 | 0.59 | 0.24 | 0.00 | 0.09 | 0.00 | 0.00 | 0.00 | 5.92 | 0.26 | 0.032 | 1.94 |
| 13 | 0.00 | 11.8 | 0.00 | 1.39 | 70.5 | 5.49 | 0.08 | 0.36 | 0.01 | 0.10 | 1.35 | 0.00 | 0.00 | 6.58 | 0.51 | 0.003 | 1.74 |
| 14 | 0.00 | 11.7 | 0.00 | 1.39 | 73.0 | 5.47 | 0.08 | 0.36 | 0.01 | 0.10 | 0.00 | 0.05 | 0.00 | 5.67 | 0.22 | 0.032 | 1.90 |
| 15 | 0.00 | 11.8 | 0.00 | 1.39 | 72.8 | 5.48 | 0.08 | 0.36 | 0.00 | 0.10 | 0.00 | 0.05 | 0.04 | 5.74 | 0.23 | 0.028 | 1.94 |
| 16 | 0.00 | 11.8 | 0.00 | 1.39 | 73.1 | 5.48 | 0.08 | 0.36 | 0.00 | 0.10 | 0.00 | 0.07 | 0.00 | 5.67 | 0.21 | 0.028 | 1.78 |
| 17 | 0.00 | 13.8 | 0.00 | 0.00 | 75.6 | 2.19 | 0.01 | 0.12 | 0.01 | 0.00 | 0.00 | 0.00 | 0.00 | 5.92 | 0.42 | 0.060 | 1.86 |
| 18 | 0.00 | 12.2 | 0.00 | 1.39 | 75.0 | 2.19 | 0.01 | 0.72 | 0.01 | 0.12 | 0.00 | 0.00 | 0.00 | 5.96 | 0.43 | 0.051 | 1.89 |
| 19 | 0.00 | 12.8 | 0.29 | 0.00 | 77.9 | 0.00 | 0.70 | 1.19 | 0.00 | 0.10 | 0.00 | 0.00 | 0.00 | 5.88 | 0.24 | 0.032 | 0.84 |
| 20 | 0.23 | 13.6 | 0.00 | 0.00 | 77.8 | 0.00 | 0.24 | 0.02 | 0.00 | 0.10 | 0.00 | 0.00 | 0.00 | 5.98 | 0.22 | 0.028 | 1.82 |

*FIG. 1*

| No. | CHEMICAL SYMBOLS | | | | | | | | | | | | | | | | |
|---|---|---|---|---|---|---|---|---|---|---|---|---|---|---|---|---|---|
| | Pr | Nd | Tb | Dy | Fe | Co | Mn | Al | Cr | Cu | Mo | Ga | Zr | B | C | N | O |
| 1 | 0.00 | 13.8 | 0.00 | 0.00 | 77.8 | 0.00 | 0.02 | 0.12 | 0.00 | 0.10 | 0.00 | 0.00 | 0.00 | 5.91 | 0.22 | 0.023 | 1.94 |
| 2 | 0.00 | 13.9 | 0.00 | 0.00 | 77.7 | 0.00 | 0.02 | 0.24 | 0.00 | 0.10 | 0.00 | 0.00 | 0.00 | 5.99 | 0.21 | 0.023 | 1.86 |
| 3 | 0.00 | 13.8 | 0.00 | 0.00 | 77.5 | 0.00 | 0.02 | 0.48 | 0.01 | 0.10 | 0.00 | 0.00 | 0.00 | 5.97 | 0.22 | 0.028 | 1.85 |
| 4 | 0.00 | 13.8 | 0.00 | 0.00 | 75.6 | 2.19 | 0.06 | 0.12 | 0.00 | 0.00 | 0.00 | 0.00 | 0.00 | 6.03 | 0.21 | 0.028 | 1.98 |
| 5 | 0.00 | 13.8 | 0.00 | 0.00 | 75.7 | 2.20 | 0.06 | 0.24 | 0.00 | 0.00 | 0.00 | 0.00 | 0.00 | 5.93 | 0.22 | 0.032 | 1.82 |
| 6 | 0.00 | 13.8 | 0.00 | 0.00 | 75.2 | 2.19 | 0.06 | 0.72 | 0.00 | 0.00 | 0.00 | 0.00 | 0.00 | 5.90 | 0.24 | 0.028 | 1.89 |
| 7 | 0.00 | 13.0 | 0.00 | 0.00 | 77.3 | 2.19 | 0.12 | 0.12 | 0.00 | 0.08 | 0.00 | 0.00 | 0.00 | 5.96 | 0.38 | 0.055 | 0.77 |
| 8 | 0.00 | 13.0 | 0.00 | 0.00 | 77.3 | 2.18 | 0.12 | 0.36 | 0.01 | 0.08 | 0.00 | 0.00 | 0.00 | 5.82 | 0.36 | 0.050 | 0.80 |
| 9 | 0.00 | 12.7 | 0.28 | 0.00 | 77.3 | 2.18 | 0.12 | 0.36 | 0.00 | 0.08 | 0.00 | 0.00 | 0.00 | 5.78 | 0.37 | 0.051 | 0.72 |
| 10 | 2.98 | 10.6 | 0.00 | 0.00 | 75.6 | 2.21 | 0.24 | 0.24 | 0.01 | 0.09 | 0.00 | 0.00 | 0.00 | 5.96 | 0.21 | 0.033 | 1.79 |
| 11 | 0.00 | 13.9 | 0.00 | 0.00 | 74.5 | 2.19 | 0.47 | 0.24 | 0.31 | 0.09 | 0.00 | 0.00 | 0.00 | 5.92 | 0.21 | 0.037 | 2.06 |
| 12 | 0.00 | 13.9 | 0.00 | 0.00 | 74.8 | 2.20 | 0.59 | 0.24 | 0.00 | 0.09 | 0.00 | 0.00 | 0.00 | 5.92 | 0.26 | 0.032 | 1.94 |
| 13 | 0.00 | 11.8 | 0.00 | 1.39 | 70.5 | 5.49 | 0.08 | 0.36 | 0.01 | 0.10 | 1.35 | 0.00 | 0.00 | 6.58 | 0.51 | 0.003 | 1.74 |
| 14 | 0.00 | 11.7 | 0.00 | 1.39 | 73.0 | 5.47 | 0.08 | 0.36 | 0.01 | 0.10 | 0.00 | 0.05 | 0.00 | 5.67 | 0.22 | 0.032 | 1.90 |
| 15 | 0.00 | 11.8 | 0.00 | 1.39 | 72.8 | 5.48 | 0.08 | 0.36 | 0.00 | 0.10 | 0.00 | 0.05 | 0.04 | 5.74 | 0.23 | 0.028 | 1.94 |
| 16 | 0.00 | 11.8 | 0.00 | 1.39 | 73.1 | 5.48 | 0.08 | 0.36 | 0.00 | 0.10 | 0.00 | 0.07 | 0.00 | 5.67 | 0.21 | 0.028 | 1.78 |
| 17 | 0.00 | 13.8 | 0.00 | 0.00 | 75.6 | 2.19 | 0.01 | 0.12 | 0.01 | 0.00 | 0.00 | 0.00 | 0.00 | 5.92 | 0.42 | 0.060 | 1.86 |
| 18 | 0.00 | 12.2 | 0.00 | 1.39 | 75.0 | 2.19 | 0.01 | 0.72 | 0.01 | 0.12 | 0.00 | 0.00 | 0.00 | 5.96 | 0.43 | 0.051 | 1.89 |
| 19 | 0.00 | 12.8 | 0.29 | 0.00 | 77.9 | 0.00 | 0.70 | 1.19 | 0.00 | 0.10 | 0.00 | 0.00 | 0.00 | 5.88 | 0.24 | 0.032 | 0.84 |
| 20 | 0.23 | 13.6 | 0.00 | 0.00 | 77.8 | 0.00 | 0.24 | 0.02 | 0.00 | 0.10 | 0.00 | 0.00 | 0.00 | 5.98 | 0.22 | 0.028 | 1.82 |

R-T-B BASED SINTERED MAGNET

This application is a continuation application U.S. application Ser. No. 12/132,689 filed on Jun. 4, 2008, which is a continuation application of International Application No. PCT/JP2007/059373, with an international filing date of May 2, 2007.

BACKGROUND OF THE INVENTION

1. Field of the Invention

The present invention relates to an R-T-B (rare-earth-iron-boron) based sintered magnet.

2. Description of the Related Art

R-T-B based sintered magnets have so good magnetic properties as to find a wide variety of applications including various types of motors and actuators and are now one of indispensable materials for the electronics industry. Also, their applications have been appreciably broadened to keep up with the recent trend toward energy saving.

Lately, however, those motors and actuators are more and more often required to exhibit much higher performance than conventional ones in their rapidly expanding applications including motors for driving, or generating electricity for, hybrid cars or motors for hoisting elevators. And their requirements are becoming increasingly severe nowadays.

One of the old drawbacks of R-T-B based magnets is their relative low Curie temperature of approximately 300° C., at which their ferromagnetism is lost. And their coercivity varies so significantly according to the temperature that irreversible flux loss will occur easily. To overcome such a problem, various measures have been taken. For example, some people tried to increase the coercivity of the R-T-B based magnets by adjusting the combination of rare-earth elements to add. Other people attempted to increase the Curie temperature by adding Co as disclosed in Patent Document No. 1. However, none of these measures will be effective enough to reduce the significant variation in coercivity with the temperature.

Several methods for increasing the coercivity have been proposed so far.

One of those methods is disclosed in Patent Document No. 2, in which heavy rare-earth elements such as Dy and Tb are included in particular percentages in the rare-earth elements. In practice, only Dy and Tb turned out to be effective enough. This method is adopted in order to increase the coercivity of the magnet as a whole, as well as the anisotropic magnetic field of its main phase that determines its magnetic properties. However, those heavy rare-earth elements such as Dy and Tb are among the rarest and most expensive ones of all rare-earth elements. For that reason, if a lot of such heavy rare-earth elements should be used, then the price of the magnets would rise. In addition, as the applications of such R-T-B based sintered magnet have been rapidly expanding these days, resource-related restrictions on those heavy rare-earth elements have become an issue these days because those rare elements are available only in very limited quantities and in very narrow areas.

Another method is disclosed in Patent Documents Nos. 3 and 4, for example, in which the coercivity is increased by introducing an additive element such as Al, Ga, Sn, Cu or Ag. It is not yet quite clear exactly how these elements can increase the coercivity. Nevertheless, it is at least known that the coercivity can be increased by changing the physical properties of a grain boundary phase (which is a so-called "R-rich phase") such as its wettability with the main phase in a high temperature range and eventually changing the microstructures with the addition of those elements. It is also known that those elements can relax the heat treatment conditions in order to increase the coercivity. However, Al, for example, could form a solid solution even in the main phase of the magnet. That is why if the amount of such an additive were increased, the Curie temperature and magnetization of the main phase would decrease, which is a problem.

Furthermore, the additive elements such as Ti, V, Cr, Zr, Nb, Mo, Hf and W disclosed in Patent Document No. 5, for example, hinder the growth of crystal grains during the sintering process and reduce the size of the resultant metallurgical structure of the sintered body, thus contributing to increasing the coercivity.

Among these methods, the method that uses heavy rare-earth elements is most effective because the decrease in magnetic flux density is relatively small according to that method. According to any of the other methods mentioned above, however, a significant decrease in the magnetic flux density of the magnet is inevitable. And those methods are applicable to only a narrow field. For that reason, in making magnets actually, these techniques are used in an appropriate combination.

Patent Document No. 1: Japanese Patent Application Laid-Open Publication No. 59-64733

Patent Document No. 2: Japanese Patent Application Laid-Open Publication No. 60-34005

Patent Document No. 3: Japanese Patent Application Laid-Open Publication No. 59-89401

Patent Document No. 4: Japanese Patent Application Laid-Open Publication No. 64-7503

Patent Document No. 5: Japanese Patent Application Laid-Open Publication No. 62-23960

In the prior art, the compositions of magnets have actually been determined by adopting those techniques in an appropriate combination to realize required good magnetic properties (and desired high coercivity, among other things). Nevertheless, there is a growing demand for magnets with even higher coercivity.

An object of the present invention is to provide means for increasing the coercivity effectively with the decrease in magnetization minimized and without always using a heavy rare-earth element such as Dy or Tb.

SUMMARY OF THE INVENTION

An R-T-B based sintered magnet according to the present invention has a composition comprising: 12 at % to 17 at % of a rare-earth element R; 5.0 at % to 8.0 at % of boron B; 0.1 at % to 1.0 at % of Al; 0.02 at % to less than 0.2 at % of Mn; and a transition metal T as the balance. The rare-earth element R is at least one element selected from the rare-earth elements, including Y (yttrium), and includes at least one of Nd and Pr. The transition element T includes Fe as its main element.

In one preferred embodiment, the magnet includes at least one of Tb and Dy as the rare-earth element R.

In another preferred embodiment, the magnet includes 20 at % or less of Co as the transition metal T.

An R-T-M-B based sintered magnet according to the present invention has a composition comprising: 12 at % to 17 at % of a rare-earth element R; 5.0 at % to 8.0 at % of boron B; 0.1 at % to 1.0 at % of Al; 0.02 at % to less than 0.2 at % of Mn; more than 0 at % to 5.0 at % (in total) of additive elements M; and a transition metal T as the balance. The rare-earth element R is at least one element selected from the rare-earth elements, including Y (yttrium), and includes at least one of Nd and Pr. The additive element M is at least one element selected from the group consisting of Ni, Cu, Zn, Ga, Ag, In, Sn, Bi, Ti, V, Cr, Zr, Nb, Mo, Hf, Ta and W. The transition element T includes Fe as its main element.

In one preferred embodiment, the magnet includes at least one of Tb and Dy as the rare-earth element R.

In another preferred embodiment, the magnet includes 20 at % or less of Co as the transition metal T.

If Al is added to an R-T-B based sintered magnet, the magnet can have increased coercivity but may have some of its magnetic properties deteriorated in terms of the Curie temperature and saturation magnetization, for example. However, by substituting Mn for a certain percentage of its T ingredient, such deterioration in magnetic properties can be minimized. That is to say, by adding very small amounts of Mn and Al, the coercivity can be increased with the deterioration in magnetic properties minimized. Besides, the loop squareness of the demagnetization curve is also improved.

BRIEF DESCRIPTION OF THE DRAWINGS

FIG. 1 is a table showing the compositions of specific examples of the present invention and comparative samples.

DETAILED DESCRIPTION OF PREFERRED EMBODIMENTS

Figure 2:
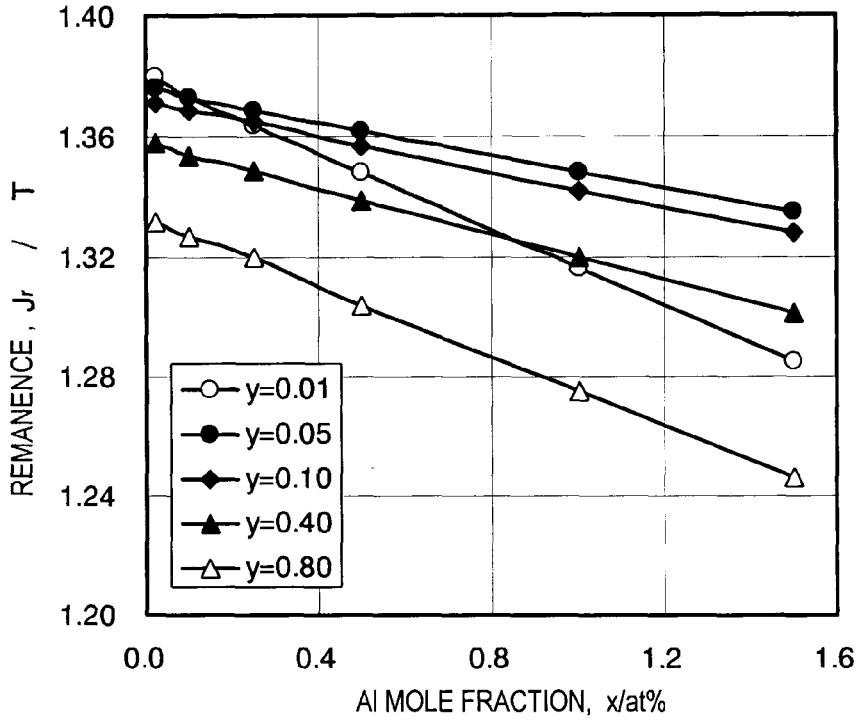
FIG. 2 is a graph showing how the dependence of the remanence on the mole fraction x of Al added changes with five mole fractions y of Mn added to an Nd—Dy—Fe—Co—Cu—B magnet.

The present inventors discovered via experiments that by adding not only Al but also a certain amount of Mn to the composition of a magnet, the decrease in magnetization and Curie temperature, which would have otherwise been caused by adding Al alone, could be minimized with the coercivity increased by the additive Al.

An R-T-B based sintered magnet according to the present invention has a composition including: 12 at % to 17 at % of a rare-earth element R; 5.0 at % to 8.0 at % of boron B; 0.1 at % to 1.0 at % of Al; 0.02 at % to less than 0.5 at % of Mn; and a transition metal T as the balance.

The rare-earth element R is at least one element selected from the rare-earth elements, including Y (yttrium), and includes at least one of Nd and Pr. The transition element T includes Fe as its main element. Optionally, to achieve various effects, at least one element selected from the group consisting of Ni, Cu, Zn, Ga, Ag, In, Sn, Bi, Ti, V, Cr, Zr, Nb, Mo, Hf, Ta and W may be added as the additive element M.

In the prior art, the effects caused by the addition of Mn have been believed to be negative ones. That is to say, it has been believed that the additive Mn would deteriorate all major magnetic properties including the Curie temperature, anisotropic magnetic field and magnetization. As for Al, on the other hand, it has certainly been known that the addition of Al would increase the coercivity of a sintered magnet but would decrease the Curie temperature and saturation magnetization. It is understood that the increase in coercivity caused by the additive Al should be due to modification of the grain boundary phase, not due to increase in the anisotropic magnetic field of the main phase. Nevertheless, those problems are caused because Al produces relatively a lot of solid solution in the main phase, too.

However, the present inventors discovered that by adding not only a predetermined amount of Al but also another predetermined amount of Mn, the concentration of Al in the main phase could be decreased and the deterioration in magnetic properties caused by the additive Al could be minimized. More specifically, in a sintered magnet including an $Nd_2Fe_{14}B$ phase as its main phase, if Fe is partially replaced with Mn, then Mn will enter the main phase by solid solution. In this case, however, Mn has an effect of reducing the concentration of Al in the main phase. As a result, the coercivity can be increased with the deterioration in magnetic properties minimized. It should be noted that the addition of Mn itself would decrease the coercivity and magnetization. However, since a very small amount of additive Mn is effective enough, such decreases in coercivity and magnetization are negligible ones.

The present inventors also discovered that by adding Mn, the behavior of the sintering reaction could also be improved during the manufacturing process of the R-T-B based sintered magnet. Specifically, since the sintering reaction advanced at lower temperatures or in a shorter time than the prior art, the resultant magnets could have not only more homogenous structure but also improved magnetic properties as well, especially in terms of the loop squareness in their demagnetization curve.

Composition

As long as it falls within the predetermined range to be defined below, the greater the mole fraction of the rare-earth element, the higher the coercivity and the smaller the residual magnetization tend to be. Specifically, if the mole fraction of the rare-earth element were less than 12 at %, the percentage of the $R_2T_{14}B$ compound as the main phase would decrease, soft magnetic phases such as α-Fe would produce instead, and the coercivity would decrease significantly. On the other hand, if the mole fraction of the rare-earth element exceeded 17 at %, the percentage of the $R_2T_{14}B$ compound as the main phase would decrease and the magnetization would drop. In addition, since excessive R would be concentrated as metal elements in the grain boundary of the main phase, water and oxygen would react to each other easily and the anticorrosiveness might decrease significantly. For these reasons, the mole fraction of R is preferably 12 at % to 17 at %, more preferably 12.5 at % to 15 at %.

Among the rare-earth elements R, at least one of Nd and Pr is indispensable to obtain a high-performance magnet. If even higher coercivity should be achieved, Tb and/or Dy could be substituted for portions of R. However, if the total mole fraction of the substituent(s) Tb and/or Dy exceeded 6 at %, the resultant residual magnetization would be lower than 1.1 T. In addition, considering its applications under high-temperature environments, in particular, the performance of the R-T-B based sintered magnet should be rather lower than that of an Sm—Co magnet. On top of that, if a lot of Tb and/or Dy were used, then the material cost of the magnet would be too high to maintain its advantage over the Sm—Co magnet. In view of these considerations, the mole fraction of Tb and/or Dy is preferably 6 at % or less to achieve good industrial applicability. Meanwhile, the other rare-earth elements, including Y, could also be included as inevitably contained impurities, although they would not produce any benefits as far as magnetic properties are concerned.

Boron is an essential element for an R-T-B based sintered magnet. The volume of the $R_2T_{14}B$ compound as the main phase is determined by that of boron. To achieve large magnetization while holding sufficient coercivity for the sintered magnet, the mole fraction of B is important. As long as it falls within the predetermined range to be defined below, the greater the mole fraction of B, the more easily sufficient coercivity could be achieved. Also, if the mole fraction of B were small, the coercivity would decrease steeply at a certain mole fraction of B. For that reason, from an industrial standpoint, it is particularly important to prevent the mole fraction of B from being short of that certain mole fraction. The greater the mole fraction of B, the lower the remanence. If the mole fraction of B were less than 5 at %, the percentage of the main phase would decrease and soft magnetic compounds other than the main phase would be produced to decrease the coercivity of the magnet eventually. However, if the mole fraction of B were greater than 8.0 at %, the percentage of the main phase would also decrease and the resultant magnet would have decreased magnetization. For these reasons, the mole fraction of B preferably falls within the range of 5.0 at % to 8.0 at %. To obtain a high-performance magnet, the mole fraction of B is more preferably 5.5 at % through 8.0 at %, even more preferably 5.5 at % through 7.0 at %.

If Al were added to an R-T-B based sintered magnet, the coercivity would increase but the magnetization and Curie temperature would both decrease. The coercivity would increase with the addition of only a small amount of Al. However, even if the amount of Al added were increased, the coercivity would not go beyond a certain level. Rather the magnetization and the Curie temperature would decrease as the amount of Al added increased. This suggests that the increase in coercivity would be caused not so much by improvement in magnetic properties of the main phase as by improvement in physical properties of the grain boundary.

In the texture of the magnet, Al is present both in the main phase and in the grain boundary. However, it should be Al in the grain boundary that contributes to increasing the coercivity. Meanwhile, Al in the main phase would have detrimental effects on the magnetic properties, and therefore, should be decreased as much as possible. For that purpose, it is effective to add Mn at the same time as will be described below.

On the supposition that Mn is also added at the same time, Al is preferably added so as to account for 0.1 at % to 1.0 at %. The reason is as follows. Specifically, if the mole fraction of Al were less than 0.1 at %, the physical properties of the grain boundary would not be improved and desired high coercivity could not be achieved. However, if the mole fraction of Al exceeded 1.0 at %, then the coercivity could not be increased anymore. In addition, even if Mn were added at the same time, an increased amount of Al will enter the main phase by solid solution, the magnetization would decrease significantly, and the Curie temperature would drop as well.

In a magnetic alloy, most of Mn would produce a solid solution in the main phase, thus decreasing the magnetization, the anisotropic magnetic field and the Curie temperature of the main phase. However, the additive Mn would decrease the amount of another additive Al that enters the main phase by solid solution.

If the mole fraction of Mn exceeded 0.5 at %, both the magnetization and the coercivity would decrease noticeably. For that reason, the mole fraction of Mn added preferably accounts for less than 0.5 at %, more preferably 0.2 at % or less. Nevertheless, if the mole fraction of Mn added were less than 0.02 at %, then the effect of the present invention would no longer manifest itself. That is why the mole fraction of Mn added is preferably at least 0.02 at %. To further improve the sintering behavior with the addition of Mn, the mole fraction of Mn added preferably accounts for 0.05 at % or more.

The only cost-effective element that would achieve the effect of improving the sinterability seems to be Mn. This is probably because Mn should be the only element to enter substantially nowhere but in the main phase by solid solution among various useful elements. In the prior art, Al and Cu were considered elements that would improve the sinterability. However, these elements would achieve the effect of improving the physical properties of the grain boundary phase but would act only indirectly on the sintering reaction of the $R_2T_{14}B$ phase as the main phase. On the other hand, Mn does contribute to the deposition of the main phase, and therefore, will act directly on the sintering reaction. For that reason, according to the present invention, the physical properties of the grain boundary phase can be improved with the addition of Al, and at the same time, the sinterability of the main phase can be improved with the addition of Mn. Consequently, by adjusting the amounts of Mn and Al added within predetermined ranges, the R-T-B based sintered magnets can be produced with good stability and efficiency.

According to the material selected, Al and Mn could be included as inevitably contained impurities. For example, Al might sometimes be included as an impurity in a ferroboron alloy and could also be included as one of the components of the crucible used in a melting process. Meanwhile, Mn could come from the material of iron or ferroboron. However, unless the amounts of Al and Mn added are both controlled within predetermined ranges, the effect of the present invention would not be achieved. To carry out the present invention, the control of the amounts of Al and Mn added needs to be started from the very first process step of making the material alloy.

In an R-T-B based sintered magnet, a portion of Fe may be replaced with Co to improve the magnetic properties (e.g., the Curie temperature) and the anticorrosiveness, among other things. When Co is added, a portion of the Co added will substitute for the main phase Fe and increase the Curie temperature. The rest of the Co added will be present in the grain boundary, produce a compound such as $Nd_3Co$ there and increase the chemical stability of the grain boundary. However, if an excessive percentage of Co were present, a ferromagnetic and soft magnetic compound would be produced in the grain boundary, reverse magnetic domains would be easily produced against the demagnetization field applied, and the magnetic domain walls would move, thus decreasing the coercivity of the magnet.

The transition metal T consists essentially of Fe. This is because an $R_2T_{14}B$ compound will achieve the highest magnetization if T is Fe. In addition, Fe is less expensive than any other useful ferromagnetic transition metal such as Co or Ni.

In carrying out the present invention, if the amount of Co added falls within the predetermined range, the harmful effects described above can be avoided. In addition, Co is preferably added because by adding Co, the Curie temperature can be increased, the anticorrosiveness can be improved and other effects will be achieved without ruining the effects of the present invention. If the mole fraction of Co added exceeded 20 at %, the magnetization would decrease significantly and the coercivity would decrease due to the precipitation of the soft magnetic phases. For that reason, the mole fraction of Co added is preferably no greater than 20 at %.

According to their functions and effects, the additive elements M can be classified into a first group consisting of Ni, Cu, Zn, Ga, Ag, In, Sn and Bi and a second group consisting of Ti, V, Cr, Zr, Nb, Mo, Hf, Ta and W. Unlike Al, any element in the first group hardly enters the main phase by solid solution but is mainly present in the grain boundary and contributes to the interaction between the grain boundary and main phases. More specifically, the element will lower the melting point of the grain boundary phase to improve the sintering behavior of the magnet or increase the wettability between the main phase and the grain boundary phase, thereby expanding the grain boundary phase into the interface with the main phase more effectively and eventually increasing the coercivity of the magnet. Among these elements, the most effective one is Cu. Although expensive, Ga and Ag will improve the properties significantly. Nevertheless, if a lot of Ni, among other things, were added, then Ni would enter the main phase by solid solution, too, to decrease the magnetization of the main phase. On the other hand, any element in the second group will make the sintered structure finer and increase the coercivity by producing very small deposition with a high melting point, for example.

No other element in the first and second groups but Ni functions as a ferromagnetic phase. For that reason, if a lot of such an element were added, the magnetization of the magnet would decrease. The same can be said about Ni. If a lot of Ni were added to produce a soft magnetic compound in the grain boundary, the coercivity would decrease. For that reason, the maximum mole fraction of these elements added is preferably 5 at % in total, more preferably 2 at % or less. Optionally, multiple elements may be picked from the first group or from the second group. Or elements in the first and second groups may be used in combination, too.

Other elements are not defined in the present invention and have nothing to do with the effect to be achieved by the present invention. However, the presence of those other elements is not necessarily ruled out according to the present invention. For example, hydrogen, carbon, nitrogen and oxygen are inevitably contained during the manufacturing process and are also detected in specific examples of the present invention, too. Among other things, carbon and nitrogen may substitute for portions of B. In that case, however, the magnetic properties will be affected significantly (e.g., the coercivity of the magnet will decrease). In a normal sintered magnet, carbon and nitrogen will react with the rare-earth element just like oxygen to produce some carbide, nitride or oxide and be present in some form that does not affect the magnetic properties. Also, hydrogen and nitrogen are expected to enter sites of the main phase between its lattices and increase the Curie temperature. However, if a lot of hydrogen or nitrogen were added, then the coercivity would also decrease. All of those effects have nothing to do with the present invention. F, Cl, Mg, Ca and other elements may get included during the process step of refining a rare-earth metal or may also stay in the composition of the magnet as it is. P and S may be included in the Fe material. Also, Si may not only come from a ferroboron alloy, which is a material source, but also get included as a crucible component while the material alloy to make the magnet is being melted.

Manufacturing Process

No matter what method is adopted to make the R-T-B based sintered magnet of the present invention, the effects of the present invention will be achieved equally. That is to say, the present invention is not limited to any specific manufacturing process. However, an exemplary manufacturing process that can be adopted will be described below.

Material Alloy

Material alloys may be prepared by any of various methods and used in any of various forms. Typical examples of preferred material alloys include an ingot alloy, a strip cast alloy, an atomized powder, a powder obtained by a reduction diffusion process and an alloy ribbon made by a rapid quenching process. Any of these material alloys may be used by itself. Or multiple material alloys of mutually different types may be used in combination as well. Still alternatively, a so-called "two-alloy process" that uses two alloys with different compositions in combination may also be adopted. In that case, Mn and Al may be included in one of the two alloys or both of the two alloys. Or Mn may be included in one of the two alloys, of which the composition is closer to that of the magnet (and which will be referred to herein as a "primary alloy"), and Al may be included in the other additional alloy. In any of these three cases, the effects of the present invention are achieved. Furthermore, improvement of sinterability, which is one of the effects to be achieved by the present invention, will also be achieved even if Al is included in the primary alloy and Mn is included in the additional alloy.

To make a material alloy, pure iron, a ferroboron alloy, pure B, a rare-earth metal, or a rare-earth-iron alloy may be used as a raw material, some of which may include, as impurities, Mn and Al that are essential elements for the present invention. That is why a raw material including Mn and Al as impurities may be used, or Mn and Al may be added separately, such that the mole fractions of Mn and Al eventually fall within their predetermined ranges. Generally speaking, it is difficult to control the mole fractions of Mn and Al to their predetermined ranges just by adjusting the amounts of impurities. For that reason, appropriate amounts of Mn and Al are preferably added to Mn and Al that are already included as impurities such that the combined mole fractions fall within their predetermined ranges.

As for the element M, the element may be added either as pure metal or as an alloy with iron, for example.

Optionally, the mother alloy may be subjected to a heat treatment in order to improve the uniformity of its structure or the distribution of elements or increase its homogeneity, for example.

Pulverization

The pulverization process may also be carried out by any arbitrary method. An appropriate method is adopted according to the attribute of the start material. For example, if a strip cast alloy is used as a start material, the alloy often needs to go through the two pulverization process steps—a coarse pulverization process step and a fine pulverization process step. In that case, the coarse pulverization may be done by either a mechanical pulverization process or a hydrogen decrepitation process, which can be used effectively to pulverize a rare-earth alloy. As used herein, the "hydrogen decrepitation process" refers to a process in which a given alloy is enclosed along with hydrogen gas in a vessel, the hydrogen gas is absorbed into the alloy, and the alloy is pulverized by utilizing the strain to be caused by the variation in the volume of the alloy. According to this method, a lot of hydrogen will get included in the coarse powder. That is why the excessive hydrogen can be released by heating the coarse powder if necessary.

Optionally, after the alloy has been pulverized coarsely but before the coarse powder is subjected to the fine pulverization process step, the coarse powder may be classified with a sieve, for example, such that all of its particle sizes are equal to or smaller than a particular particle size.

The fine pulverization usually gets done by a jet milling process that uses a jet flow. Alternatively, a mechanical fine pulverization process or a wet ball milling process that uses a dispersion medium may also be adopted. Also, before the pulverization process is started, a pulverization assistant may be added in advance. This is particularly useful to increase the pulverization efficiency of the fine pulverization process step.

As for how to handle the material alloy or the coarse powder, it is important to handle them in an inert atmosphere to make a high-performance magnet. As far as it is handled at ordinary temperatures, it should be enough if the inert atmosphere is nitrogen gas. However, if a heat treatment should be conducted at 300° C. or even higher temperatures, helium gas or argon gas needs to be used as the inert atmosphere.

The objective particle size of the pulverized powder is determined by the intended performance of the magnet and various restrictions to be imposed in the next compaction process step. Normally, the objective particle size may be a D50 particle size of 3 μm to 7 μm according to the laser diffraction analysis using the gas dispersion technique. This particle size falls within such a particle size range that is easily achieved by a jet milling process. The particle sizes of the fine powder are supposed to be measured by the gas dispersion process because the fine powder is a ferromagnetic that easily aggregates magnetically.

Compaction

To make an anisotropic sintered magnet, the fine powder is compacted under a magnetic field and magnetic anisotropy is given to the magnet. In general, the fine powder obtained by the pulverization process is loaded into the die holes of a press machine, a cavity is formed by upper and lower punches with a magnetic field applied externally, and the fine powder is pressed and compacted with the punches and then unloaded. In this process, a lubricant may be added to the fine material powder to increase the degree of alignment with the magnetic field applied or to increase the lubricity of the die. The lubricant may be a solid one or a liquid one, which may be determined with various factors into consideration. Optionally, the fine powder may be granulated appropriately to be loaded into the die holes more easily, for example.

Also, as the aligning magnetic field, not only a static magnetic field generated by a DC power supply but also a pulse magnetic field generated by discharge of a capacitor or an AC magnetic field may be used as well.

If the composition of the present invention is adopted, the magnetic field applied preferably has a strength of 0.4 MA/m or more usually, and more preferably has a strength of 0.8 MA/m or more. After the compaction process, reverse magnetic field may be applied to perform a demagnetizing process. By performing such a demagnetizing process, the compact can be handled more easily after that because the compact will have no remnant magnetization.

Optionally, if the directions of applying the magnetic field during the compaction process are changed according to a special pattern, a magnet with any of various aligned states can be made. As for ring magnets, for example, the magnets may not only be axially aligned but also radially aligned or anisotropically aligned so as to have multiple magnetic poles.

The compaction process does not have to be performed using the die and punches as described above. Alternatively, the compaction process may also be performed using a rubber mold. For example, a method called "RIP" may also be adopted.

Optionally, the compaction and the application of the magnetic field may be performed separately.

Sintering

The sintering process is carried out in either a vacuum or an argon gas atmosphere. The pressure and other parameters of the atmosphere may be determined arbitrarily. For example, a process in which the pressure is reduced with Ar gas introduced or a process in which the pressure is increased with Ar gas may be adopted. In the magnet of the present invention, the gas that has been introduced into the material powder before the sintering process may be released during a temperature increase process. Or in order to vaporize off the lubricant, the binder or the compaction aid that has been added during the temperature increase process, the temperature increase process is sometimes carried out at a reduced pressure during the sintering process. Or the compact may sometimes be maintained at a certain temperature for a certain period of time during the temperature increase process. Also, to vaporize off the lubricant, binder or compaction aid more efficiently, a hydrogen atmosphere may be created in a particular temperature range during the temperature increase process. Optionally, the sintering process may be carried out in a helium gas atmosphere. However, helium gas is expensive here in Japan and the thermal efficiency of the sintering furnace could decrease due to the good heat conduction of the helium gas.

The sintering process is usually carried out at a temperature of 1,000° C. to 1,100° C. for 30 minutes to 16 hours. In the composition range of the present invention, the sintering process causes a liquid phase in the compact of the present invention, and therefore, the temperature does not have to be so high. If necessary, a number of sintering processes may be performed either at the same temperature or multiple different temperatures. As for the cooling process after the temperature has been held, it is not always necessary to perform a rapid cooling process or a gradual cooling process. Alternatively, various conditions (including those of the heat treatment process to be described below) may be combined appropriately.

After the sintering process, the magnet of the present invention can have a specific gravity of at least 7.3, more preferably 7.4 or more.

Optionally, any other sintering means for use in a powder metallurgical process, such as a hot press in which the object is heated while being subjected to an external pressure or an electro-sintering process in which a given compact is supplied with electricity and heated with Joule heat, may also be adopted. If any of those alternative means is adopted, the sintering temperature and process time do not have to be as described above.

Heat Treatment

To increase the coercivity, the sintered body may be subjected to some heat treatment at a temperature that is equal to or lower than the sintering temperature. Optionally, the heat treatment may be conducted a number of times at either the same temperature or multiple different temperatures. In performing the heat treatment, various conditions may be set for the cooling process.

It should be noted that if the as-sintered body already has sufficient coercivity, there is no need to subject it to any heat treatment.

Machining

The sintered body sometimes has a shape that is close to its final one, but in most cases, is subjected to some machining process such as cutting, polishing or grinding to have its shape finished into a predetermined one. As long as it is done after the sintering process, this machining process may be carried out either before or after the heat treatment process or between multiple heat treatment processes.

Surface Treatment

In a normal environment, a sintered magnet with a composition according to the present invention would rust in the long run. That is why the magnet should be subjected to some surface coating treatment appropriately. Examples of preferred surface treatments include resin coating, metal plating, and vapor deposition of a film. Among these various surface treatments, an appropriate one is selected with the application, required performance and cost taken into consideration. Depending on the operating environment, there might be no need to protect the magnet by such a surface treatment. In that case, the surface treatment could be omitted.

Magnetization

A magnet according to the present invention is usually magnetized with a pulse magnetic field. This magnetization process is often carried out after the magnet has been built in the product for the convenience of the assembling process. However, it is naturally possible to magnetize the magnet by itself and then build the magnet into the product.

The magnetizing direction needs to be determined with the aligning direction for the compaction process under the magnetic field taken into consideration. Usually a high-performance magnet cannot be obtained unless these two directions agree with each other. Depending on the application, however, the aligning direction for the compaction process does not have to agree with the magnetizing direction.

EXAMPLES

Example 1

An alloy with an objective composition was prepared by mixing together Pr and Nd with a purity of 99.5% or more, Tb and Dy with a purity of 99.9% or more, electrolytic iron, and low-carbon ferroboron alloy together with the other objective elements added in the form of pure metals or alloys with Fe. The alloy was then melted and cast by a strip casting process, thereby obtaining a plate-like alloy with a thickness of 0.3 mm to 0.4 mm.

This material alloy was subjected to a hydrogen decrepitation process within a hydrogen atmosphere with an increased pressure, heated to 600° C. in a vacuum, cooled and then classified with a sieve, thereby obtaining a coarse alloy powder with a mean particle size of 425 μm or less. Then, zinc stearate was added to, and mixed with, this coarse powder so as to account for 0.05 mass % of the powder.

Next, the coarse alloy powder was subjected to a dry pulverization process using a jet mill machine in a nitrogen gas flow, thereby obtaining a fine powder with a particle size D50 of 4 μm to 5 μm. In this process, as for a sample that should have 1 at % or less of oxygen, the concentration of oxygen in the pulverization gas was controlled to 50 ppm or less. This particle size was obtained by the laser diffraction analysis using the gas dispersion technique.

The fine powder thus obtained was compacted under a magnetic field to make green compacts. In this process, a static magnetic field of approximately 0.8 MA/m and a compacting pressure of 196 MPa were applied. It should be noted that the direction in which the magnetic field was applied and the direction in which the compacting pressure was applied were orthogonal to each other. Also, as for a sample that should have the objective oxygen content, the sample was transported from the pulverizer into the sintering furnace so as to be kept in a nitrogen atmosphere as much of the time as possible.

Next, those green compacts were sintered at a temperature of 1,020° C. to 1,080° C. for two hours in a vacuum. The sintering temperature varied according to the composition. In any case, the sintering process was carried out at as low a temperature as possible as far as the sintered compacts would have a density of 7.5 $Mg/m^3$.

The compositions of the sintered bodies thus obtained were analyzed and converted into atomic percentages as shown in FIG. 1. The analysis was carried out using an ICP. However, the contents of oxygen, nitrogen and carbon were obtained with a gas analyzer. Each of these samples was subjected to a hydrogen analysis by a dissolution technique. As a result, the contents of hydrogen in those samples were in the range of 10 ppm to 30 ppm. The resultant magnetic properties are shown in the following Table 1:

TABLE 1

| | Magnetic properties | | |
|---|---|---|---|
| No. | $J_r$/T | $H_{cJ}$/$kAm^{-1}$ | $T_c$/K |
| 1 | 1.366 | 945 | 585 |
| 2 | 1.364 | 952 | 585 |
| 3 | 1.363 | 946 | 584 |
| 4 | 1.365 | 926 | 602 |
| 5 | 1.365 | 922 | 602 |
| 6 | 1.362 | 925 | 600 |
| 7 | 1.455 | 933 | 601 |
| 8 | 1.448 | 948 | 601 |
| 9 | 1.412 | 1132 | 599 |
| 10 | 1.356 | 964 | 598 |
| 11 | 1.330 | 1084 | 599 |
| 12 | 1.332 | 915 | 597 |
| 13 | 1.220 | 2230 | 636 |
| 14 | 1.322 | 1425 | 637 |
| 15 | 1.320 | 1463 | 637 |
| 16 | 1.324 | 1431 | 636 |
| 17 | 1.364 | 741 | 601 |
| 18 | 1.259 | 1420 | 597 |
| 19 | 1.286 | 1024 | 576 |
| 20 | 1.345 | 715 | 583 |

In addition to the elements shown in the table, not only hydrogen but also Si, Ca, Cr, La, Ce and other elements could be detected. In most cases, Si would come from the crucible while the ferroboron material and the alloy were being melted, and Ca, La and Ce would come from the rare-earth material. And Cr could be included in iron. It is impossible to reduce all of these impurities to absolutely zero.

The sintered bodies thus obtained were thermally treated at various temperatures for an hour within an Ar atmosphere and then cooled. The heat treatment was conducted with the temperatures changed according to the composition. Also, some samples were subjected to the heat treatment up to three times with the temperatures changed. After those samples were machined, their magnetic properties $J_r$ and $H_{cJ}$ at room temperature were measured with a B—H tracer. Meanwhile, portions of the samples were scraped off and used as samples with weights of 20 to 50 mg, which were put on a thermobalance under a magnetic field to find their Curie temperatures $T_c$. According to this method, a weak magnetic field generated by a permanent magnet is applied to each sample from outside of the thermobalance and a variation in the magnetic force of the sample that is being transformed from a ferromagnetic body into a paramagnetic body is sensed with the balance. Specifically, the value indicated by the balance is differentiated to find a temperature at which the variation rate becomes a local maximum. It should be noted that among the samples that had been thermally treated under various conditions, those exhibiting the highest coercivity at room temperature were used as objects of evaluation.

Samples #17 to #20 represent comparative examples. Specifically, Samples #17 and #18 included less than 0.02 at % of Mn and exhibited lower remanence $J_r$ and lower Curie temperature $T_c$ than specific examples of the present invention with similar compositions. More particularly, Sample #17 included less than 0.02 at % of Mn and exhibited low coercivity $H_{cJ}$ although Al had been added thereto. On the other hand, Sample #19 included excessive amounts of Mn and Al and exhibited a low remanence $J_r$ and a low Curie temperature $T_c$. And Sample #20 included excessive amounts of Mn and less than 0.1 at % of Al and its coercivity $H_{cJ}$ was particularly low. Samples #10 to #12 also represent comparative examples including more than 0.2 at % of Mn and exhibited a low remanence $J_r$.

Example 2

Figure 3:
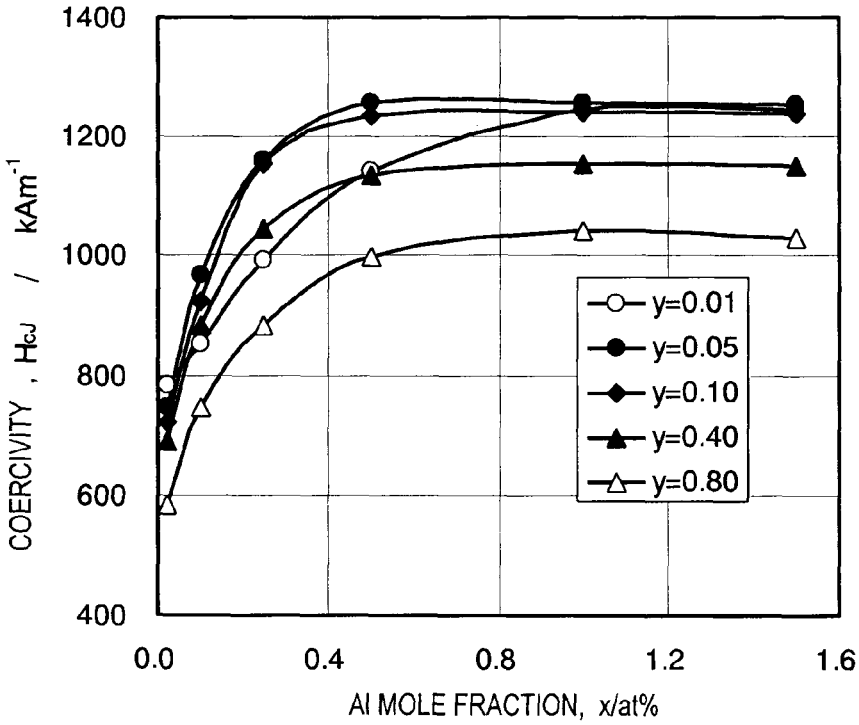
FIG. 3 is a graph showing how the dependence of the coercivity on the mole fraction x of Al added changes with five mole fractions y of Mn added to an Nd—Dy—Fe—Co—Cu—B magnet.

Magnets, of which the compositions were represented by $Nd_{13.0}Dy_{0.7}Fe_{ba1.}Co_{2.2}Cu_{0.1}B_{5.9}Al_xMn_y$ (where subscripts are atomic percentages), had their remanence $J_r$ and coercivity $H_{cJ}$ measured at room temperature with y set to be 0.01, 0.05, 0.10, 0.40 and 0.80 and with the mole fraction x of Al varied. The results are shown in FIGS. 2 and 3, respectively. The curves associated with y=0.01 provide data about a comparative example. In this specific example, the content of oxygen was 1.8 at %, the contents of carbon and nitrogen were 0.4 at % or less and 0.1 at % or less, respectively, and the contents of other inevitable impurities such as Si, Ca, La and Ce were 0.1 at % or less. The magnets of this Example 2 were produced by the same method as that adopted for Example 1.

As shown in FIG. 2, when y=0.05, the decrease in remanence $J_r$ with the increase in the amount of Al added was less significant than the situation where y=0.01. This result was obtained probably due to a reduction in the concentration of Al in the main phase with the addition of Mn. Also, when y=0.80, the concentration of Mn in the main phase increased so much as to decrease the remanence $J_r$ significantly.

On the other hand, as can be seen from FIG. 3, Al further increased its concentration on the grain boundary phase with the addition of Mn. As a result, the more Mn was added, the smaller the percentage of Al added to achieve the same coercivity $H_{cJ}$. Also, when y=0.80, a concentration of Mn which forms (produces) a solid solution in the main phase increased so much as to decrease the coercivity $H_{cJ}$ significantly.

Example 3

Figure 4:
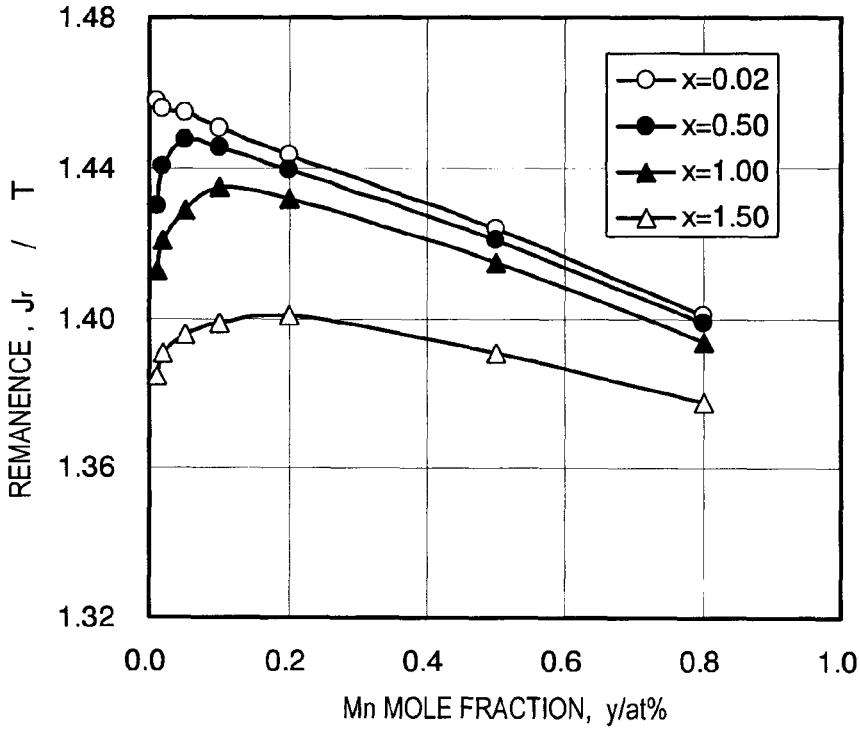
FIG. 4 is a graph showing how the dependence of the remanence on the mole fraction y of Mn added changes with four mole fractions x of Al added to an Nd—Fe—Co—Cu-Ga—B magnet.
Figure 5:
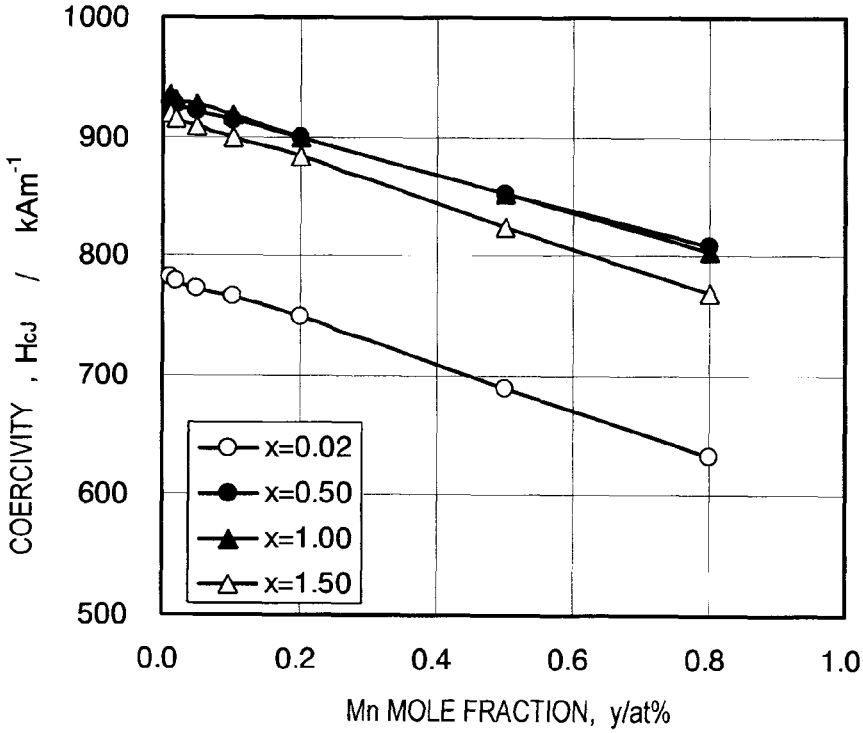
FIG. 5 is a graph showing how the dependence of the coercivity on the mole fraction y of Mn added changes with four mole fractions x of Al added to an Nd—Fe—Co—Cu-Ga—B magnet.

Magnets, of which the compositions were represented by $Nd_{12.8}Fe_{ba1.}Co_{2.2}Cu_{0.1}Ga_{0.05}B_{5.7}Al_xMn_y$ (where subscripts are atomic percentages), had their remanence $J_r$ and coercivity $H_{cJ}$ measured at room temperature with x set to be 0.02, 0.50, 1.00 and 1.50 and with the mole fraction y of Mn varied. The results are shown in FIGS. 4 and 5, respectively. The curves associated with x=0.02 and 1.50 provide data about comparative examples. In this specific example, the content of oxygen was 1.8 at %, the contents of carbon and nitrogen were 0.4 at % or less and 0.1 at % or less, respectively, and the contents of other inevitable impurities such as Si, Ca, La and Ce were 0.1 at % or less. The magnets of this Example 3 were produced by the same method as that adopted for Example 1.

According to the results shown in FIG. 4, if Al was added so as to account for a mole fraction x of 0.5 at % without adding Mn, the remanence $J_r$ decreased significantly. However, when y=0.05, the difference in remanence $J_r$ was very small no matter whether Al was added or not. Also, when x=1.50, a concentration of Al itself which forms (produces) a solid solution in the main phase increased so much as to decrease the remanence $J_r$ significantly.

On the other hand, as can be seen from the results shown in FIG. 5, with the addition of Al, the coercivity $H_{cJ}$ increased uniformly, irrespective of the amount of Mn added.

Example 4

Sintered magnets with the compositions shown in the following Table 2 were obtained by the same method as that adopted for Example 1. The compositions shown in Table 2 are analyzed values that were converted into atomic percentages based on the results of ICP and gas analysis. Each of those sintered magnets includes not only the elements shown in Table 2 but also other inevitable impurities such as hydrogen, carbon, nitrogen, Si, Ca, La and Ce.

TABLE 2

| | Chemical symbols | | | | | | | | | |
|---|---|---|---|---|---|---|---|---|---|---|
| No. | Nd | Tb | Dy | Fe | Co | Mn | Al | Cu | B | O |
| 21 | 12.0 | | | 80.8 | | 0.06 | 0.48 | 0.10 | 5.87 | 0.72 |
| 22 | 12.5 | | | 80.3 | | 0.06 | 0.48 | 0.10 | 5.86 | 0.72 |
| 23 | 15.0 | | | 76.5 | | 0.06 | 0.48 | 0.10 | 5.90 | 1.92 |
| 24 | 17.0 | | | 74.4 | | 0.06 | 0.48 | 0.10 | 6.10 | 1.85 |
| 25 | 16.8 | | | 75.4 | | 0.06 | 0.48 | 0.10 | 5.06 | 2.11 |
| 26 | 14.0 | | | 77.9 | | 0.06 | 0.48 | 0.10 | 5.51 | 1.91 |
| 27 | 13.2 | | | 78.4 | | 0.06 | 0.48 | 0.10 | 7.00 | 0.72 |
| 28 | 14.0 | | | 75.5 | | 0.06 | 0.48 | 0.10 | 8.00 | 1.88 |
| 29 | 13.2 | | 0.67 | 77.8 | | 0.06 | 0.48 | 0.10 | 5.93 | 1.78 |
| 30 | 13.2 | | 0.68 | 72.4 | 5.30 | 0.06 | 0.48 | 0.10 | 5.92 | 1.90 |
| 31 | 13.1 | | 0.68 | 68.3 | 9.50 | 0.06 | 0.48 | 0.10 | 5.86 | 1.94 |
| 32 | 13.2 | | 0.66 | 57.7 | 20.00 | 0.06 | 0.48 | 0.10 | 5.86 | 1.90 |

TABLE 2-continued

| | Chemical symbols | | | | | | | | | |
|---|---|---|---|---|---|---|---|---|---|---|
| No. | Nd | Tb | Dy | Fe | Co | Mn | Al | Cu | B | O |
| 33 | 11.8 | | 2.05 | 75.6 | 2.10 | 0.06 | 0.48 | 0.10 | 5.92 | 1.90 |
| 34 | 9.0 | | 4.50 | 76.0 | 2.10 | 0.06 | 0.48 | 0.10 | 5.90 | 1.89 |
| 35 | 11.1 | 1.52 | 1.20 | 75.6 | 2.10 | 0.06 | 0.48 | 0.10 | 5.92 | 1.90 |
| 36 | 10.2 | 3.50 | | 75.7 | 2.10 | 0.06 | 0.48 | 0.10 | 5.91 | 1.94 |

The magnetic properties of the magnets are shown in the following Table 3:

TABLE 3

| | Magnetic properties | | |
|---|---|---|---|
| No. | $J_r$/T | $H_{cJ}$/kAm$^{-1}$ | $T_c$/K |
| 21 | 1.457 | 684 | 584 |
| 22 | 1.433 | 732 | 585 |
| 23 | 1.320 | 954 | 584 |
| 24 | 1.239 | 948 | 585 |
| 25 | 1.181 | 583 | 584 |
| 26 | 1.349 | 930 | 585 |
| 27 | 1.373 | 941 | 585 |
| 28 | 1.298 | 945 | 585 |
| 29 | 1.334 | 1236 | 586 |
| 30 | 1.332 | 1252 | 626 |
| 31 | 1.340 | 1244 | 628 |
| 32 | 1.339 | 1228 | 661 |
| 33 | 1.279 | 1760 | 602 |
| 34 | 1.092 | 2500 | 601 |
| 35 | 1.245 | 2440 | 602 |
| 36 | 1.245 | 2860 | 602 |

The remanences $J_r$, coercivities $H_{cJ}$ and Curie temperatures $T_c$ were estimated by the same methods as those adopted for Example 1 and shown in this table. This specific example shows how the magnetic properties varied with the contents of R, B, and Co when the contents of Al and Mn were fixed. Each of these samples exhibited good magnetic properties.

Example 5

Sintered magnets, of which the compositions were represented by $Nd_{13.8}Fe_{ba1.}Al_{0.2}Mn_xB_{6.0}$ (where subscripts are atomic percentages), were made with the mole fraction x varied and had their magnetic properties measured. The results are shown in the following Table 4:

TABLE 4

| | Mole fraction | Density | Magnetic properties | | |
|---|---|---|---|---|---|
| No. | x of Mn (at %) | ρ/MGm$^{-3}$ | $J_r$/T | $H_{cJ}$/kAm$^{-1}$ | $H_k/H_{cJ}$ |
| 37 | 0.01 | 7.36 | 1.357 | 867 | 0.927 |
| 38 | 0.02 | 7.51 | 1.397 | 924 | 0.967 |
| 39 | 0.05 | 7.53 | 1.399 | 932 | 0.983 |
| 40 | 0.10 | 7.54 | 1.396 | 911 | 0.986 |
| 41 | 0.15 | 7.54 | 1.392 | 898 | 0.985 |
| 42 | 0.20 | 7.55 | 1.388 | 892 | 0.987 |
| 43 | 0.25 | 7.54 | 1.383 | 881 | 0.987 |
| 44 | 0.30 | 7.54 | 1.380 | 865 | 0.986 |
| 45 | 0.40 | 7.54 | 1.371 | 850 | 0.983 |
| 46 | 0.50 | 7.55 | 1.363 | 842 | 0.982 |
| 47 | 0.60 | 7.53 | 1.355 | 781 | 0.980 |
| 48 | 0.80 | 7.54 | 1.336 | 748 | 0.980 |

The same manufacturing process as that adopted for Example 1 was also carried out. Every magnet with any of these compositions was sintered at 1,020° C. for two hours. The sintered body was thermally treated at a temperature falling within the range of 560° C. to 640° C. Samples with the best magnetic properties were subjected to the measurement. The magnetic properties were evaluated by calculating $H_k$ as an index and figuring out $H_k/H_{cJ}$ as an index to loop squareness. In this case, $H_k$ represents a value of a demagnetization field when the value of magnetization becomes 90% of the remanence $J_r$. The closer to one the $H_k/H_{cJ}$ ratio is, the better the loop squareness and the more useful the magnet should be. If the mole fraction x of Mn was equal to or greater than 0.02 at %, the density ρ and the remanence $J_r$ increased sensibly. On the other hand, if the mole fraction x of Mn was greater than 0.5 at %, the remanence $J_r$ decreased significantly to equal to or lower than the level in a situation where no Mn was added.

According to the results of a gas analysis, 0.41 mass % to 0.44 mass % of oxygen, 0.037 mass % to 0.043 mass % of carbon, 0.012 mass % to 0.015 mass % of nitrogen, and less than 0.002 mass % of hydrogen were included as inevitable impurities in the sintered magnets. Also, according to the results of the ICP analysis, at most 0.04 mass % of Si and 0.01 mass % or less of Cr, Ce, Ca, etc. was detected.

Example 6

A material alloy was prepared by either an ingot process or a strip casting (SC) process. The alloy was then coarsely pulverized by a hydrogen decrepitation process and finely pulverized with a jet mill, thereby obtaining a fine powder with a particle size D50 of 4.1 μm to 4.8 μm. Thereafter, zinc stearate was added as an internal lubricant to the fine powder so as to account for 0.05 mass % of the powder. And the mixture was compacted with a die under a magnetic field. In this process, the field strength was 1.2 MA/m and the compacting pressure was 196 MPa. The direction in which the pressure was applied was perpendicular to the direction in which the magnetic field was applied.

The green compacts thus obtained were sintered in a vacuum with temperature settings changed according to their composition, thereby making sintered bodies with densities of 7.5 Mgm$^{-3}$ or more. The sintered bodies thus obtained were thermally treated at various temperatures and then machined to make sample magnets. Then, the magnetic properties thereof were measured with a BH tracer as a closed circuit. As for samples with coercivities of 1500 kAm$^{-1}$ or more, the coercivities thereof were measured again by a pulse method using a TPM type magnetometer (produced by Toei Industry Co., Ltd.)

Two of these samples (#58 and #62) were obtained by performing the fine pulverization and the rest of the manufacturing process substantially in an inert gas atmosphere.

The following Table 5 shows the compositions of the sintered magnets thus obtained as ICP analysis values, where the values of O were obtained by converting those obtained by a gas analysis into atomic percentages. The magnetic properties of respective samples under the conditions that resulted in the best coercivity are shown in the following Table 6:

TABLE 5

| TP No. | Material alloy | Compositions of sintered magnets Nd | Dy | Fe | Co | Al | Mn | B | M | O |
|---|---|---|---|---|---|---|---|---|---|---|
| 49 | SC | 13.2 | 0.6 | 77.7 | 0.21 | 0.50 | 0.05 | 5.95 | Ni: 0.20 | 1.83 |
| 50 | SC | 13.3 | 0.6 | 77.8 | | 0.50 | 0.05 | 5.83 | Cu: 0.10 | 1.77 |
| 51 | SC | 13.2 | 0.7 | 77.6 | | 0.50 | 0.05 | 5.95 | Zn: 0.14 | 1.85 |
| 52 | SC | 13.2 | 0.6 | 78.0 | 0.11 | 0.50 | 0.05 | 5.72 | Ga: 0.05 | 1.78 |
| 53 | SC | 12.5 | 1.2 | 77.6 | 0.42 | 0.50 | 0.05 | 5.97 | Ag: 0.05 | 1.74 |
| 54 | Ingot | 12.5 | 1.2 | 77.4 | 0.42 | 0.50 | 0.05 | 6.01 | Sn: 0.10 | 1.85 |
| 55 | Ingot | 12.6 | 1.2 | 77.9 | 0.11 | 0.50 | 0.05 | 5.65 | Cu: 0.10 + Ga: 0.05 | 1.88 |
| 56 | SC | 12.2 | 1.6 | 74.9 | 0.22 | 0.50 | 0.10 | 6.54 | V: 2.0 | 1.97 |
| 57 | SC | 12.3 | 1.6 | 77.0 | 0.22 | 0.50 | 0.10 | 6.08 | Cr: 0.5 | 1.73 |
| 58 | SC | 11.8 | 1.2 | 77.7 | 2.21 | 0.50 | 0.10 | 5.64 | Zr: 0.10 | 0.71 |
| 59 | SC | 12.8 | 1.2 | 76.7 | 0.22 | 0.50 | 0.10 | 6.03 | Nb: 0.7 | 1.78 |
| 60 | Ingot | 12.2 | 1.6 | 73.3 | 0.54 | 0.50 | 0.10 | 6.89 | Mo: 3.0 | 1.82 |
| 61 | SC | 12.4 | 1.6 | 74.8 | 0.54 | 0.50 | 0.10 | 6.62 | Cu: 0.10 + Mo: 1.5 | 1.86 |
| 62 | Ingot | 1.2 | 1.2 | 77.2 | 2.21 | 0.72 | 0.07 | 5.72 | Zr: 0.11 | 0.74 |

TABLE 6

| TP No. | Magnetic properties $J_r$/T | $H_{cJ}$/kAm$^{-1}$ |
|---|---|---|
| 49 | 1.396 | 1132 |
| 50 | 1.404 | 1160 |
| 51 | 1.392 | 1143 |
| 52 | 1.401 | 1167 |
| 53 | 1.365 | 1233 |
| 54 | 1.361 | 1228 |
| 55 | 1.368 | 1256 |
| 56 | 1.140 | 2280 |
| 57 | 1.348 | 1326 |
| 58 | 1.375 | 1311 |
| 59 | 1.344 | 1288 |
| 60 | 1.124 | 2350 |
| 61 | 1.211 | 2330 |
| 62 | 1.360 | 1245 |

No matter whether the alloy was prepared by the ingot process or the strip casting process, good magnetic properties were realized by adding both Al and Mn along with any additive element.

As other impurities that are not shown in Table 5, 0.031 mass % to 0.085 mass % of carbon, 0.013 mass % to 0.034 mass % of nitrogen, less than 0.003 mass % of hydrogen, less than 0.04 mass % of Si, and less than 0.01 mass % of La, Ce and Ca (apiece) were detected.

A sintered magnet according to the present invention can be used extensively in various applications that require high-performance sintered magnets.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. An R-T-B based sintered magnet having a composition comprising:

12 at % to 15 at % of a rare-earth element R;

5.0 at % to 8.0 at % of B;

0.1 at % to 1.0 at % of Al;

0.02 at % to less than 0.2 at % of Mn; and a transition metal T as the balance; wherein the rare-earth element R is at least one element selected from a group of elements consisting of the rare-earth elements and Y and includes at least one of Nd and Pr; and the transition metal T includes Fe as its main element.

2. The R-T-B based sintered magnet of claim 1, wherein the rare-earth element R includes at least one of Tb and Dy in addition to the at least one of Nd and Pr.

3. The R-T-B based sintered magnet of claim 1, wherein the magnet includes 20 at % or less of Co as the transition metal T.

4. An R-T-M-B based sintered magnet having a composition comprising:

12 at % to 15 at % of a rare-earth element R;

5.0 at % to 8.0 at % of B;

0.1 at % to 1.0 at % of Al;

0.02 at % to less than 0.2 at % of Mn;

more than 0 at % to 5.0 at % (in total) of additive elements M; and a transition metal T as the balance; wherein the rare-earth element R is at least one element selected from a group of elements consisting of the rare-earth elements and Y and includes at least one of Nd and Pr;

the additive element M is at least one element selected from the group consisting of Ni, Cu, Zn, Ga, Ag, In, Sn, Bi, Ti, V, Cr, Zr, Nb, Mo, Hf, Ta and W; and the transition metal T includes Fe as its main element.

5. The R-T-M-B based sintered magnet of claim 4, wherein the rare-earth element R includes at least one of Tb and Dy in addition to the at least one of Nd and Pr.

6. The R-T-M-B based sintered magnet of claim 4, wherein the magnet includes 20 at % or less of Co as the transition metal T.

* * * * *